United States Patent [19]

Upchurch

[11] 4,069,866

[45] Jan. 24, 1978

[54] PRESSURE APPORTIONING VALVE APPARATUS FOR USE WITH MULTIPLE PACKERS

[75] Inventor: James M. Upchurch, Sugar Land, Tex.

[73] Assignee: Schlumberger Technology Corporation, New York, N.Y.

[21] Appl. No.: 750,929

[22] Filed: Dec. 15, 1976

[51] Int. Cl.[2] ..... E21B 33/13; E21B 43/00

[52] U.S. Cl. ..... 166/147; 166/319

[58] Field of Search ..... 166/147, 319, 127

[56] References Cited

U.S. PATENT DOCUMENTS

| | | | |
|---|---|---|---|
| 2,458,631 | 1/1949 | Parks | 166/147 |
| 2,864,449 | 12/1958 | Tausch | 166/319 |
| 3,291,219 | 12/1966 | Nutter | 166/147 |

*Primary Examiner*—James A. Leppink

*Attorney, Agent, or Firm*—David L. Moseley; William R. Sherman; Stewart F. Moore

[57] ABSTRACT

In accordance with an illustrative embodiment of the present invention, a valve apparatus adapted for use in drill stem testing to apportion a pressure differential across two vertically spaced packers includes a housing mounted between the packers and having a flow passage leading from the exterior to the interior thereof, a first valve means including a spring-loaded mandrel arranged to close the passage at a preselected difference in pressures inside and outside the housing, and a second valve means that also can close the passage after a measured quantity of fluids has flowed through the passage.

15 Claims, 5 Drawing Figures

FIG. 3
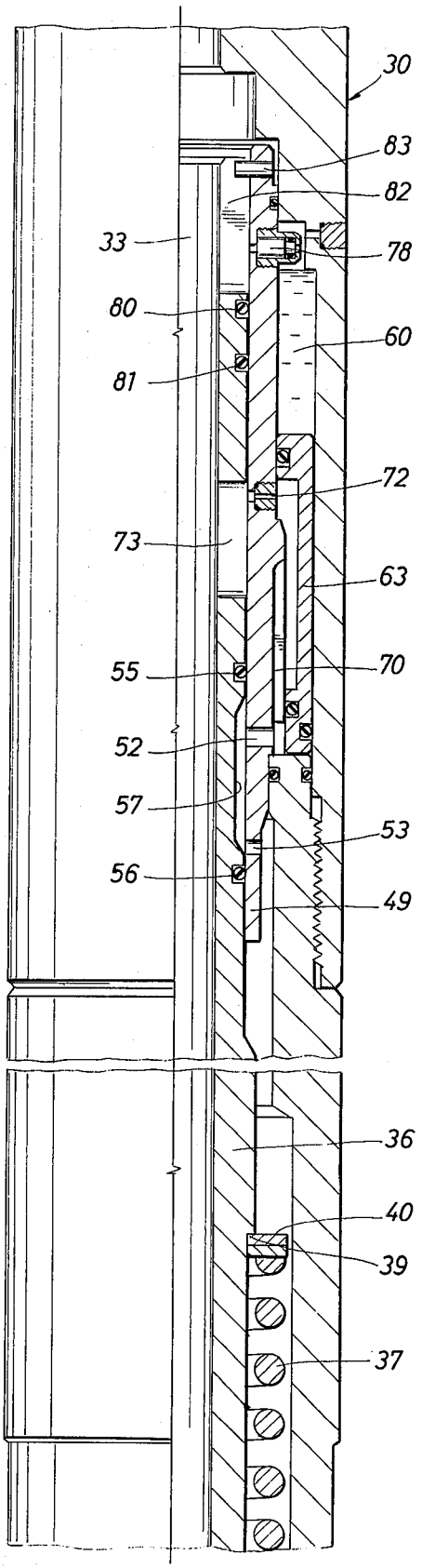
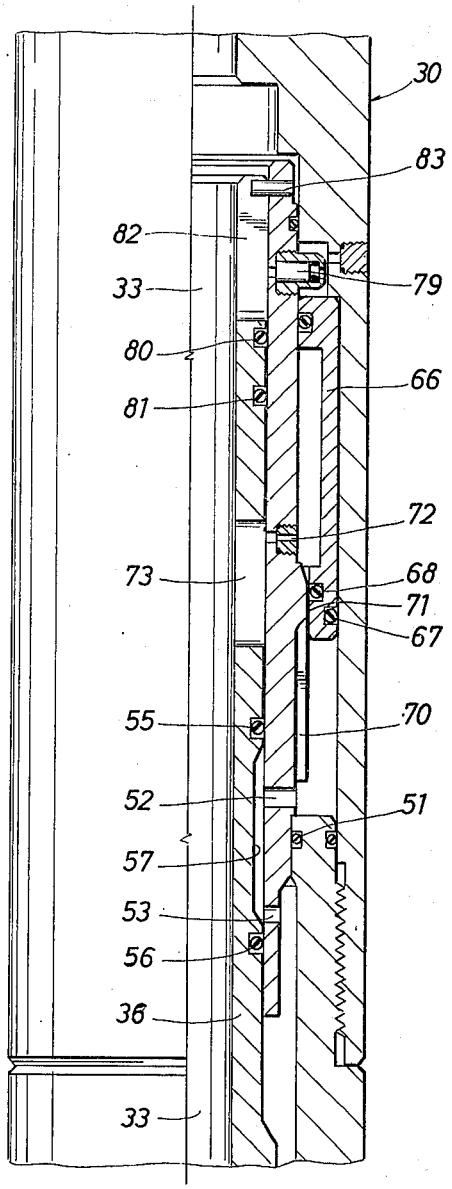
FIG. 4

PRESSURE APPORTIONING VALVE APPARATUS FOR USE WITH MULTIPLE PACKERS

This invention relates generally to drill stem testing of earth formations penetrated by a borehole, and particularly to a new and improved valve apparatus for proportioning the pressure drop, and thus the mud column load, across each of several packers that are connected in series or tandem and employed to isolate an interval of the borehole being tested.

When conducting a drill stem test in either an open or a cased well bore, it is typical practice to isolate the interval being tested from the hydrostatic head of the column of fluids in the well by the use of a packer that is connected in a pipe string. The packer is normally retracted as the testing tools and pipe string are lowered into position, and then is expanded into sealing contact with the borehole wall by either inflatable or mechanical means. After expansion the packer seals off the annulus between the pipe string and the well bore wall and thereby isolates the test interval from the pressure of the fluids in the well thereabove.

On occasion it has been recognized that one packer may not sustain the great pressure of the mud column. This can occur in very deep well testing (which is becoming more and more common) and in other situations where a relatively heavy drilling mud weight must be employed to overbalance a very high formation fluid pressure. In either case, it may be desirable to run two or more packers in tandem to sustain the mud column weight, provided the load can be distributed substantially evenly among the several packers.

Various apparatus for distributing the load between multiple packers are known in the art. For example, U.S. Pat. No. 3,500,911, issued Mar. 17, 1970, shows a device which comprises a spring loaded valve sleeve that controls a fluid communication path from the annular space between two packers and the interior of the pipe string. The valve opens as the tools are being lowered into the well bore, and remains open as the packers are set. The valve closes at a point subsequent to the opening of the tester valve when the pressure between the packers has bled down to provide a predetermined pressure differential calculated to provide for distribution of part of the total load of the mud column to each packer. However, this device suffers a number of shortcomings. For one thing the design is such that after the tester valve is closed to enable inside pressure to build up during the so-called "shut-in" period of the test, the pressure may build up to a value that is above the previously reduced annulus pressure. The increased inside pressure will cause the valve to open and enable the annulus to be repressurized, causing a disruptive effect on the pressure record that is being made. Thus as a practical matter, where the hydrostatic head is not much greater than the expected formation pressure, the valve must be set to close at a value which distributes almost all of the total pressure load to the lower packer, which is, of course, undesirable. Another shortcoming of this device is that if the upper packer fails to retain its seat, and thus leaks fluid in a downward direction, the valve will remain open and cause the pipe string to be filled with mud, which also is undesirable.

It is an object of the present invention to provide a new and improved apparatus of the type described which functions to apportion the mud column load between two or more packers in a preselected manner.

Another object of the present invention is to provide a new and improved mud column weight apportioning apparatus used in connection with tandem packers that will not allow the annular space between the packers to be repressurized.

These and other objects are attained in accordance with the concepts of the present invention through the provision of a pressure regulating valve apparatus adapted to be connected in between upper and lower tandem packers. The apparatus comprises a spring-loaded valve mandrel movable vertically within a housing between a first position blocking flow through a flow passage leading from the exterior of the housing to the interior thereof, and a second position enabling such flow to occur. The mandrel is sealingly slidable within the housing and provided with a transverse pressure area that is subject to the difference in the pressures of well fluids inside and outside the housing such that a predominate outside pressure acts in opposition to the reaction force of the spring, and a predominate inside pressure acts in concert with the spring. The spring is arranged to be preloaded in compression prior to insertion of the tools into the well, whereby the valve mandrel moves initially to the open or second position when the test valve is opened to reduce the interior pressure, and then moves to the closed or first position when the differential in pressures inside and outside reached a predetermined level. As the interior pressure continues to increase, and eventually reaches a value in excess of external pressure, the excess pressure aids the spring in holding the valve mandrel in the closed position.

In combination with the foregoing elements is provided a metering valve system that functions to shut off the flow of fluids or "mud" from the exterior of the housing to the interior thereof after a discrete, measured quantity of fluids has flowed to the said interior. This system comprises an oil-filled chamber having a movable valve piston at one end thereof subject to the pressure of fluids in the flow passage, and functioning to transmit such pressure to the oil in the chamber. An orifice means lets the oil exit the chamber to the interior of the housing at a metered rate, so that the valve piston moves from an initially open to a closed position with respect to said flow passage only after a measured quantity of fluids has flowed through said passage. The use of this system in the combination provides for an eventual closing of the flow passage from the well annulus to the interior of the housing even though the upper packer fails to retain sealing engagement with the well bore wall, and thereby enables the test to be continued.

The present invention has other objects and advantages which will become more clearly apparent in connection with the following detailed description of a preferred embodiment, taken in conjunction with the appended drawings in which:

FIG. 3 is a fragmentary view to illustrate the pressure regulating valve mandrel in the open position; and FIG. 4 is a view similar to FIG. 3 but with the metering valve moved to closed position.

Figure 1:
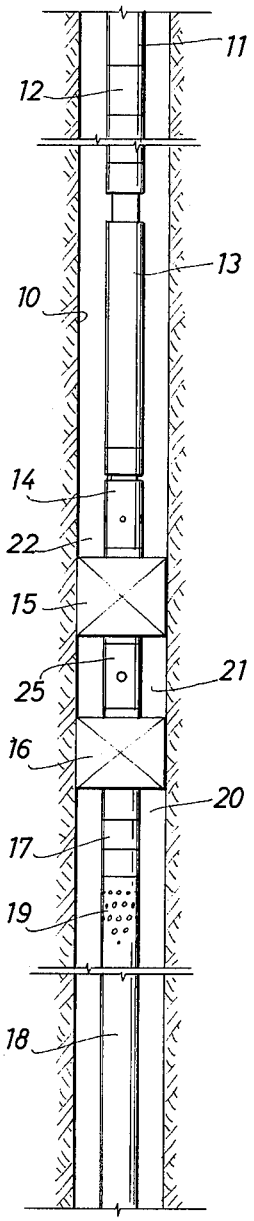
FIG. 1 is a schematic illustration of a string of drill stem testing tools disposed in a well bore.

Referring initially to FIG. 1, there is shown schematically a string of drill stem testing tools disposed in an open or uncased, fluid-filled well bore 10 that has penetrated an earth formation interval to be tested. The tools are suspended on a drill stem or pipe 11 that extends upwardly to the top of the well, and includes, in a typical manner, a reverse circulating valve 12, a main test valve assembly 13, a bypass valve 14, and tandemly connected packers 15 and 16. The lower packer 16 is connected to a recorder sub 17 which houses inside and outside reading pressure recorders, and to a perforated anchor or tail pipe 18 which stands on the bottom of the borehole 10. Other conventional components, such as a safety joint and a jar, may be connected between the bypass valve 14 and the tester valve 13, but are not shown to simplify the disclosure. The tools are run into the well bore with the tester valve 13 closed, the bypass valve 14 open, and the packers 15 and 16 in a relaxed and retracted condition. The length of the anchor 18 is selected to position the packers 15 and 16 above the well interval to be tested, and when the anchor is landed on bottom the bypass 14 is closed and the packers are expanded into sealing contact with the well bore wall to isolate the interval from the hydrostatic head of the column of fluids thereabove. The pipe 11 initially may be substantially empty of fluids to provide a low pressure region into which formation fluids from the isolated interval can flow when the tested valve 13 is opened, for example, by appropriate manipulation of the pipe string. The formation fluids enter through the perforations 19 and pass upwardly through the tools as the recorders 17 make a record of pressure changes versus elapsed time. Of course the tester valve 13 may be closed to enable recordal of pressure build-up data in a typical manner as will be apparent to those skilled in the art. For a more detailed disclosure of the structure of the various tool components mentioned thus far, reference may be had to U.S. Pat. No. 3,308,887, Nutter, assigned to the assignee of this invention.

The packers 15 and 16 when expanded as shown in FIG. 1 divide the well bore into three regions, an isolated region 20 below the lower packer 16, an annular region 21 between the two packers, and an upper region 22 immediately above the upper packer 15. When the tester valve 13 is opened to initiate the test, the pressure of fluids within the lower region 20 of the well suddenly is decreased to a very low value, which may be approximately atmospheric pressure, and the packers 15 and 16 are required to sustain extremely large forces due to the hydrostatic head of the column of fluids standing in the well region 22 thereabove. In order to accomplish the objects of the present invention, a valve apparatus 25 is attached between the packers 15 and 16 and functions to apportion the pressure drop across respective packers in a preselected manner, preferably equally, to ensure a fluid-tight pack off of the isolated interval therebelow during the test. The structural details of the valve apparatus 25 are shown in FIGS. 2A and 2B.

Figure 2A:
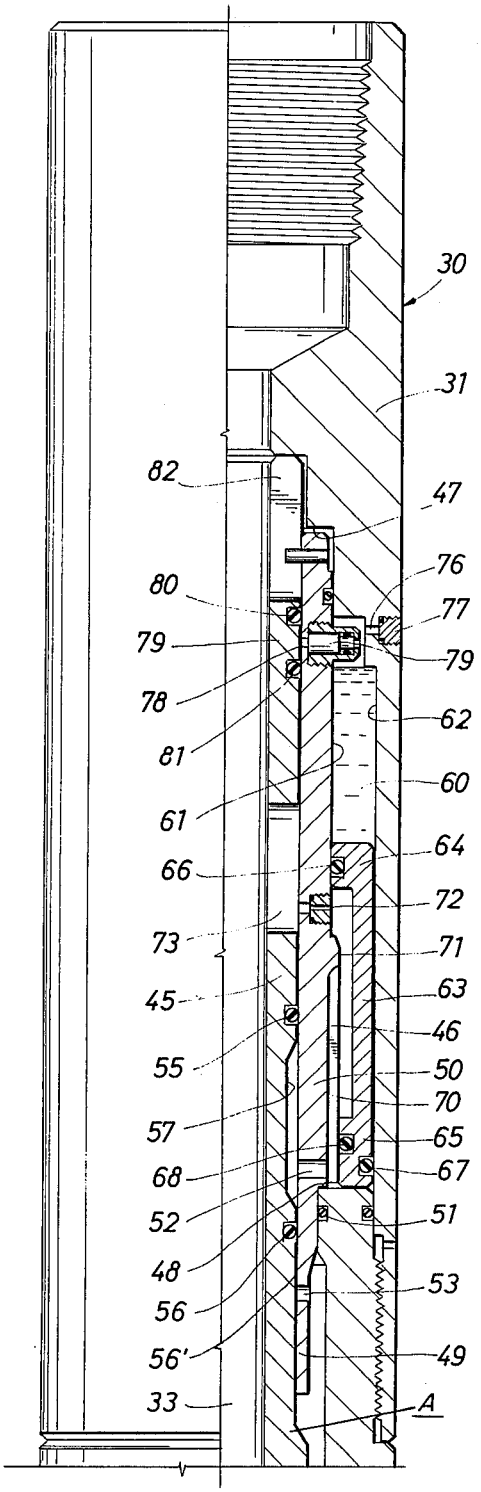
FIGS. 2A and 2B are longitudinal sectional views, with portions in side elevation, of the valve apparatus of the present invention, FIG. 2B forming a lower continuation of FIG. 2A.
Figure 2B:
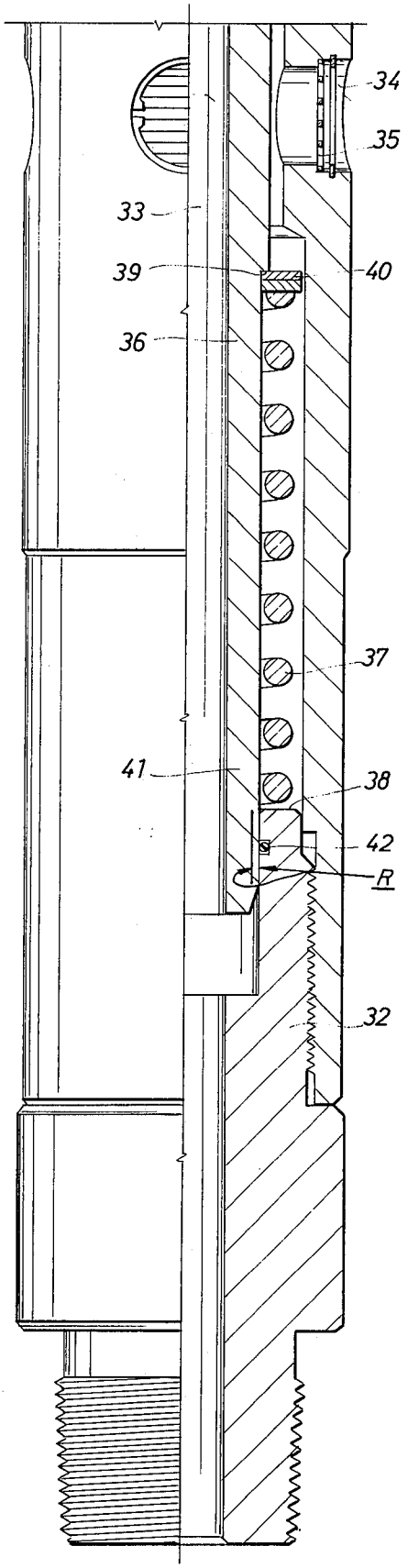

Referring now to FIG. 2A, the apparatus 25 includes an elongated tubular housing 30 made up of several threadedly connected parts including an upper sub 31 that is attached to the lower end of the upper packer 15, and a lower sub 32 that is connected to the upper end of the lower packer 16. The housing 30 has a central passage 33 through which formation fluids can flow, and a plurality of circumferentially spaced openings 34 in the wall thereof in communication with the annular region 21 of the well bore. If desired, the openings 34 can be screened by elements 35 to prevent solids or debris from coming into the inside of the housing 30. An elongated tubular valve mandrel 36 is movable vertically within the housing 30 between upper and lower positions and is urged upwardly by a coil spring 37 which reacts between an upwardly facing shoulder 38 on the lower sub 32 and a downwardly facing shoulder 39 on the mandrel 36. A selected number of annular spacers or washers 40 may be positioned between the shoulder 39 and the top of the spring 37 to preset the initial compression or preload of the spring 37. The lower end portion 41 of the mandrel 36 is sealed with respect to the housing 30 by an O-ring 42.

The upper end portion 45 of the valve mandrel 36 is sealingly slidable within a sleeve 46 that is fixed within the housing by oppositely facing shoulder surfaces 47 and 48 and may be considered as a part thereof. The sleeve 46 has a reduced diameter skirt 49 at its lower end and an enlarged, outwardly directed shoulder section 50 intermediate its ends, with the skirt being sealed with respect to the housing 30 by an O-ring 51. Upper and lower sets of radial ports 52 and 53 extend through the wall of the sleeve 46 with the lower ports 53 being at all times in communication with the exterior of the housing 30 via the housing ports 34. The valve mandrel 36 is provided with O-rings 55 and 56 respectively above and below an external annular recess 57 therein which is elongated sufficiently to place the radial ports 52 and 53 in fluid communication when the mandrel 36 occupies its lower position within the housing 30. On the other hand when the valve mandrel is in its upper position within the housing as shown in FIG. 2A, the seal ring 56 engages a seal surface 56' to thereby block fluid communication of the ports 52 and 53. It will be recognized that the diameter of sealing engagement of the seal 56 is less than that of the previously mentioned seal 42 to provide the mandrel 36 with an upwardly facing transverse surface *a* that is subject to pressure of fluids externally of the housing 30, and a resultant, downwardly facing transverse surface *a* that is subject to the pressure of fluids internally of the housing 30.

An elongated annular cylinder or cavity 60 is formed within the housing 30 by virtue of the lateral spacing between the outer wall surface 61 of the sleeve 41 and an inner wall surface 62 of the housing 30. A metering valve element 63 having enlarged upper and lower end portions 64 and 65 is movable vertically within the cylinder 60 and carries an upper inner seal ring 66 and a lower outer seal ring 67 in engagement with the respective wall surfaces 61 and 62 of the sleeve and housing. In addition, the element 63 carries a lower inner seal ring 68 which functions as a valve seal as will be subsequently described. The shoulder section 50 of the sleeve 46 is provided with a plurality of circumferentially spaced, vertically extending flow grooves 70 whose upper ends terminate immediately below an annular outwardly facing valve seat surface 71. Another plurality of flow ports 72 extend through the wall of the sleeve 46 above the seat surface 71 and are in communication with the throughbore of the mandrel 36 via elongated flow slots 73 through the wall of the mandrel.

The upper region of the chamber 60 above the upper portion 64 of the metering piston 63 is arranged to be filled with a liquid such as oil through a fill port 76 which normally is closed by a plug 77. The oil may exit the chamber through an outlet port 78 after having passed through an orifice device 79. The orifice device 79 preferably is a commercially available device that employs a plurality of discs mounted one behind the other to form a complex fluid passage such that the time response remains substantially constant even though there are wide changes in the viscosity and temperature of the metering fluid. The outlet port 78 is, however, normally closed off by the adjacent wall portion of the valve mandrel 36 between the seals 80 and 81 to prevent fluid leakage when the mandrel is in the upper position shown in FIG. 2A. On the other hand when the valve mandrel 36 is moved downwardly, the port 78 is registered with a slot 82 formed through the wall of the upper end of the mandrel to enable metering liquid to exit the chamber 60. Guide pins 83 on the upper end of the sleeve 46 may be slidably engaged in the slots 82 to maintain alignment of the orifices 72 with the mandrel flow slots 73, and the outlet orifice 78 with the slot 82, in the lower position of the mandrel 36 within the housing 30.

In operation, the apparatus 25 is prepared at the surface to be run into the well to a selected setting depth by filling the metering chamber 60 above the metering and valve piston 63 with oil, and by assembling the apparatus with a selected number of spacers 40 to preload or precompress the spring 37 by a predetermined amount to program the magnitude of pressure differential at which the valve mandrel 36 can move upwardly to its closed position. By way of example and not limitation, the setting depth of the packers may be 10,000 ft. where the hydrostatic head of the fluids filling the borehole is 5000 psi. In this case the spring 37 could be preloaded to cause the mandrel to close at a pressure differential of 2500 psi. The various tool components then are interconnected and lowered into the well as previously described to perform a drill stem test. When the packers 15 and 16 are set, initially the well bore regions 20–22 are at substantially the same pressure, (perhaps the region 21 could be somewhat higher due to "squeeze" pressure applied to fluids therein as the packers are set) which is the hydrostatic head pressure at test depth. When the tester valve 13 is opened, the pressure in the region 20 drops to atmospheric or other low value, whereby substantially the total head pressure acts downwardly on the valve mandrel 36 over a transverse cross-sectional area defined by the difference in areas bounded by the seals 42 and 56. The downward force shifts the valve mandrel 36 downwardly within the housing 30, further compressing the spring 37, and aligning the recess 57 with the upper and lower sets of ports 53 and 52 as shown in FIG. 3. Well fluid from the annular region 21 between the set packers 15 and 16 then is permitted to flow to the bore 33 via the ports 53, the recess 57, the ports 52, the grooves 70, the outlet jets 72 and the mandrel slots 73. Such flow reduces the pressure in the annular region 21 between the upper and lower packers 15 and 16 until the downward force due to pressure differential acting on the mandrel 36 becomes slightly less than the upward bias force afforded by the spring 37, at which point the valve mandrel will shift upwardly to its closed position where the O-ring 56 is located between the sets of ports 52 and 53. In the example given above, closing will occur at a differential of about 2500 psi. Thus, the reduction in the pressure of the fluids trapped in the region 21 between the packers 15 and 16 apportions or "stages" the pressure drop across each packer, so that the packers may share the weight of the total fluid head.

During the time that the valve mandrel 36 is in the lower open position, liquid in the chamber 60 above the piston 63 meters through the orifice 78 because external pressure is transmitted to the oil by the piston. As the oil meters to the bore 33, the piston 63 moves upwardly within the chamber. Should the valve mandrel 36 fail to shift to its upper closed position because the upper packer 15 fails to retain its seat against the borehole wall, flow of well fluids from the region 21 to the interior of the tools will be cut off when the piston 63 reaches the upper limits of its travel and the seal ring 68 engages the seat surface 71. Shut off thus will occur after a measured amount of well fluids has left the annulus. This feature enables the well test to be performed though the upper packer seat fails, so long as the lower packer 16 remains seated.

It also will be recognized by those skilled in the art that if interior of formation pressure builds up during the shut-in period of the test to a value that is above the previously reduced pressure of the well fluids trapped in the region 21 between the packers by closure of the valve mandrel 36, the predominate interior pressure acts across the area bounded by the seals 42 and 56 in the same direction as the pressure of the spring 37 to hold the valve mandrel in the upper or closed position. Thus the valve mandrel 36 cannot be reopened by increased internal pressure, which is a significant advantage over prior devices where such reopening could occur and have a disruptive effect on the pressure records being made by the recorders 17.

At the completion of the drill stem test, the bypass valve 14 is opened to equalize pressures and the packers 15 and 16 are unseated. The circulating valve 12 may be opened to move formation fluids collected in the pipe string 11 to the surface by pressuring the well annulus. Then the pipe 11 and the string of test tools are withdrawn from the well to the surface.

It now will be recognized that a new and improved apparatus has been provided for apportioning the total load due to hydrostatic head to spaced packers in equal or other selected incremental amounts. The staging of the pressure drop is assured because the valve mandrel will not reopen as inside pressure builds up to a value above the outside pressure between packers (in fact the valve mandrel is held closed with increased force). Moreover, even in a case where the upper packer seat is lost, the valve apparatus will close after a measured quantity of annulus fluid has passed from the annulus to the inside of the valve apparatus.

Since certain changes or modifications may be made by those skilled in the art without departing from the scope of the inventive concepts involved, it is the aim of the appended claims to cover all such changes and modifications falling within the true spirit and scope of the present invention.

I claim:

1. Apparatus for use in apportioning a pressure differential to spaced packers adapted to seal off the annulus between a pipe string and a well conduit wall, comprising: a tubular housing adapted to be connected between spaced packers, said housing having a flow passage leading from the exterior to the interior thereof; a valve mandrel sealingly slidable and movable longitudinally within said housing between first and second positions; valve means on said mandrel and said housing enabling a flow of fluid from the exterior to the interior of said housing in said second position and blocking said flow in said first position; said mandrel having a stepped outer diameter providing first transverse surface means subject to the pressure of fluids externally of said housing and second resultant transverse surface means subject to the pressure of fluids internally of said housing; and bias means for applying bias force to said mandrel that acts to move said mandrel to said first position at a predetermined difference in the pressure of fluids acting on said surface means.

2. The apparatus of claim 1 wherein said passage comprises first and second vertically spaced port means in said housing, said valve means including an annular seal surface intermediate said port means, and seal means on said valve mandrel disengaged from said seal surface to communicate said port means in said second position and engaged with said seal surface to isolate said port means from each other in said first position.

3. The apparatus of claim 2 wherein said housing includes laterally spaced inner and outer walls defining an annular cavity therebetween, said cavity providing a portion of said passage and being in fluid communication with one of said vertically spaced port means.

4. The apparatus of claim 3 wherein said passage includes third port means for communicating said cavity with the interior of said housing, said third port means providing a lesser flow area than said first or said second port means whereby the pressure of fluids in said cavity when said valve mandrel is in said first position is substantially equal to the pressure of fluids externally of said housing.

5. The apparatus of claim 4 further including additional valve means for shutting off flow of fluids through said passage after a measured quantity of said fluid has passed via said passage to the interior of said housing.

6. The apparatus of claim 5 wherein said additional valve means comprises a pressure responsive element movable longitudinally within said cavity between an open position and a closed position with respect to said passage, said element having one side thereof exposed to the pressure of fluids downstream of said first-mentioned valve means; a metering liquid in said cavity on the other side of said pressure responsive element, and orifice means for enabling flow of said metering liquid to the interior of said housing in a manner to control movement of said pressure responsive element from said open position to said closed position.

7. Apparatus for use in apportioning a pressure drop to spaced packers adapted to seal off the annulus between a pipe string and a well conduit wall, comprising: housing means adapted to be connected between spaced packers and having a fluid passage leading from the exterior to the interior thereof; first valve means for closing said passage at a preselected differential in pressures externally and internally of said housing means; and second valve means for automatically closing said passage after a measured quantity of fluids has passed via said passage from the exterior to the interior of said housing means.

8. The apparatus of claim 7 wherein said first valve means comprises a normally closed, spring-loaded valve mandrel movable longitudinally in said housing means from an open position to a closed position with respect to said passage and having a transverse surface subject to the pressure of fluids externally of said housing means and a resultant transverse surface subject to the pressure of fluids internally of said housing means.

9. The apparatus of claim 7 wherein said second valve means includes a pressure responsive element located in said housing means downstream of said first valve means and being driven by the pressure of fluids in said passage while said first valve means is open from a normally open position to a closed position with respect to said passage.

10. The apparatus of claim 9 including timer means for controlling the closing of said second valve means to occur only after said measured quantity of fluids has flowed through said passage.

11. The apparatus of claim 10 wherein said timer means comprises fluid containing chamber means, and orifice means communicating said chamber means with the interior of said housing means, said pressure responsive element defining a wall of said chamber means and functioning to transmit the pressure of fluids in said passage to the fluid within said chamber means, whereby loss of said fluid from said chamber means via said orifice means controls the rate at which said second valve means moves from said open position to said closed position.

12. The apparatus of claim 11 wherein said orifice means is constructed and arranged to provide a resistance to fluid flow that is substantially independent of changes in viscosity of the fluid in said chamber means.

13. The apparatus of claim 11 wherein said passage comprises vertically spaced port means in said housing means, said first valve means and said housing means having coengageable means for preventing fluid communication between said port means in the closed position of said first valve means.

14. The apparatus of claim 13 wherein said passage further includes additional port means in said housing means, said second valve means and said housing means having coengageable means for preventing flow of said fluids through said additional port means in the closed position of said second valve means.

15. The apparatus of claim 14 wherein said additional port means provides a lesser flow area then either of said vertically spaced port means whereby the pressure of fluids in said passage upstream of said additional port means can act on said pressure responsive element and be transmitted thereby to the fluid contained in said chamber means and cause said fluid to exit said chamber means via said orifice means to the interior of said housing means for so long as said first and second valve means remains open.

* * * * *